US006176935B1

(12) United States Patent
Brahmbhatt

(10) Patent No.: US 6,176,935 B1
(45) Date of Patent: Jan. 23, 2001

(54) SYSTEM AND METHOD FOR REFINING SUGAR

(75) Inventor: Sudhir R. Brahmbhatt, Glencoe, MO (US)

(73) Assignee: MG Industries, Malvern, PA (US)

( * ) Notice: Under 35 U.S.C. 154(b), the term of this patent shall be extended for 0 days.

(21) Appl. No.: 09/318,540

(22) Filed: May 25, 1999

(51) Int. Cl.[7] ..... C13D 3/06; C13D 3/00

(52) U.S. Cl. ..... 127/52; 127/12; 127/50

(58) Field of Search ..... 127/12, 50, 52

(56) References Cited

U.S. PATENT DOCUMENTS 5,480,490 * 2/1996 Toth et al. ..... 127/42
6,085,549 * 11/2000 Daus et al. ..... 62/624

OTHER PUBLICATIONS

Abstract of article "The use of pure $CO_2$ in the sugar industry", Sakharnaya Promyshlennost Journal, (1973) No Month Provided VNIISP, USSR.

* cited by examiner

*Primary Examiner*—David Brunsman
(74) *Attorney, Agent, or Firm*—William H. Eilberg

(57) ABSTRACT

A sugar refining process uses carbon dioxide obtained from a module containing a plurality of gas-permeable polymeric membranes. Flue gas from a boiler is scrubbed, and then passed through the gas-separation module. The output of the module contains an enhanced concentration of carbon dioxide, in the range of about 20% by volume. The carbon dioxide enhanced gas is then directed into a reactor in which raw sugar is exposed to carbon dioxide to cause carbonation, an essential step in the decolorization of the raw sugar. The same boiler used to produce the carbon dioxide is also used to produce steam which drives the reaction. The present invention provides carbon dioxide for carbonation in a highly efficient manner, as the gas separation membrane has no moving parts and requires little maintenance. The invention is especially suited for retrofitting existing sugar refining plants, to improve their efficiency, at a relatively small cost.

18 Claims, 2 Drawing Sheets

SYSTEM AND METHOD FOR REFINING SUGAR

BACKGROUND OF THE INVENTION

The present invention relates to the field of sugar refining, and provides a system and method which improves the efficiency of the refining process.

Raw sugar is obtained by extracting the juice from sugar cane, and processing the juice to produce sugar crystals. The raw sugar is light brown in color, due to the presence of color bodies in the crystals. The color of the crystals is determined by the content of organic chemicals in the sugar. A primary object of the refining process is to convert the raw, brown sugar into white sugar.

A major component of the sugar refining process is known as carbonation. In the carbonation step, carbon dioxide is added to raw sugar which has been dissolved to form a clarified liquor. The carbon dioxide reacts with calcium in the sugar to form calcium carbonate ($CaCO_3$). The calcium carbonate precipitates out of the sugar, and takes with it a large proportion of the color bodies. In fact, in a single carbonation step, more than 60% of the coloring matter may be removed. The precipitate can then be removed by filtration. The carbonation step may be repeated, or it may be followed by additional refining steps, such as treatment with activated carbon. These further steps can remove most or all of the remaining color bodies.

The carbonation step may be enhanced by adding lime (CaO) to the reactor which contains the raw sugar. The lime provides more calcium than that which is naturally found in raw sugar or sugar cane. The lime thereby enhances the production of calcium carbonate by providing more calcium atoms to react with the applied carbon dioxide, according to the reaction $$CaO+C0_2 \rightarrow CaCO_3.$$

Because carbonation is the major step in removing coloring matter from raw sugar, it is important to maintain a reliable source of carbon dioxide in a sugar refinery. The reliability of the source of carbon dioxide is a major determinant of the productivity of a sugar refining plant. If the supply of carbon dioxide is curtailed, the entire operation of the plant is correspondingly limited.

Various methods of providing carbon dioxide have been used in the sugar refining industry. A typical approach is to derive carbon dioxide from the effluent of the exhaust of a boiler. A sugar refinery includes a boiler which provides steam which heats the contents of the reactor, thereby increasing the rate of the sugar-refining reactions. The boiler exhaust is itself a source of carbon dioxide. It has therefore been known to recover the boiler exhaust, to purify it (such as by use of a gas scrubber), and to use the purified stream in the above-described sugar-refining reactions. If the fuel for the boiler is natural gas, which is the usual fuel in such applications, the boiler exhaust will contain about 6–9% carbon dioxide, by volume. If some other fuel is used (such as coke, propane, heavy oil, or fuel oil), the percentage of carbon dioxide could be outside of the above range.

The major disadvantage of using the boiler exhaust as a source of carbon dioxide is that if a problem with the boiler develops, it may be necessary to reduce the boiler output. In the latter case, the supply of carbon dioxide is thereby reduced, thus affecting the operation of the entire plant. Similarly, if the purity of the fuel decreases, less carbon would be available for combustion, and the amount of carbon dioxide produced would be correspondingly reduced.

The latter occurrence is quite possible where the boiler is fueled by natural gas, because the purity of a natural gas stream may vary continuously over time.

The risk of an interruption in the carbon dioxide supply, due to a problem with the boiler, or due to fluctuations in the purity of the fuel, can be offset by providing a backup source of carbon dioxide on the premises. But providing such backup, which could require storage of large tanks of compressed gas or liquefied gas, is inconvenient and expensive. For this reason, the usual approach is to reduce production when there is an interruption in the source of carbon dioxide.

Another solution, proposed in an article entitled "The use of pure $CO_2$ in the sugar industry", Sakharnaya Promyshlennost (1973), is to treat chemically the flue gases from the boiler so as to produce pure carbon dioxide for use in the refining process. The above-cited article suggests treating the flue gas with monoethanolamine, which absorbs carbon dioxide, and later desorbs it, thereby providing pure $C0_2$ for use in carbonation. While the latter system works, it is expensive, as it requires the additional steps of handling chemicals. Moreover, most existing installations do not have the capability of processing sugar rapidly enough to justify the use of pure carbon dioxide. Thus, for most sugar refineries, the use of pure carbon dioxide would be unduly expensive relative to the benefit conferred.

The present invention provides a system and method which substantially increases the efficiency of a sugar refining plant. The present invention requires no special chemicals, and can be conveniently used with existing refining plants to increase their productivity.

SUMMARY OF THE INVENTION

In the system of the present invention, flue gases from a boiler are first scrubbed, and then passed through a gas separation membrane module. The membrane module contains a plurality of gas-permeable polymeric membranes which are chosen for their ability to separate carbon dioxide from other gases. After the gas has passed through the membrane module, the concentration of carbon dioxide in the stream is increased to about 20% by volume. This stream is then injected into a reactor containing raw sugar, to perform the step of carbonation, and thus to remove most of the coloring matter from the raw sugar.

In the preferred embodiment, the boiler used as the source of carbon dioxide is the same boiler used to produce steam which drives the reaction. Thus, the present invention uses exhaust from an already existing boiler, and efficiently converts that exhaust into a usable source of carbon dioxide.

The present invention therefore has the primary object of improving the process of sugar refining.

The invention has the further object of providing a sugar refining process which includes a reliable means of supplying carbon dioxide for use in a carbonation step.

The invention has the further object of providing an improvement to a sugar refining system, wherein the improvement can be easily incorporated into existing refineries.

The invention has the further object of reducing or eliminating the need for an auxiliary supply of pure carbon dioxide, in a sugar refining plant.

The invention has the further object of improving the efficiency and throughput of a sugar refining process.

The invention has the further object of minimizing interruptions to production in a sugar refining plant, by providing a steady and reliable source of carbon dioxide.

The invention has the further object of providing a stream of carbon dioxide, for use in a sugar refining process, wherein the carbon dioxide is provided without using special chemicals.

The reader skilled in the art will recognize other objects and ad- vantages of the present invention, from a reading of the following brief description of the drawings, the detailed description of the invention, and the appended claims.

DETAILED DESCRIPTION OF THE INVENTION

Figure 1:
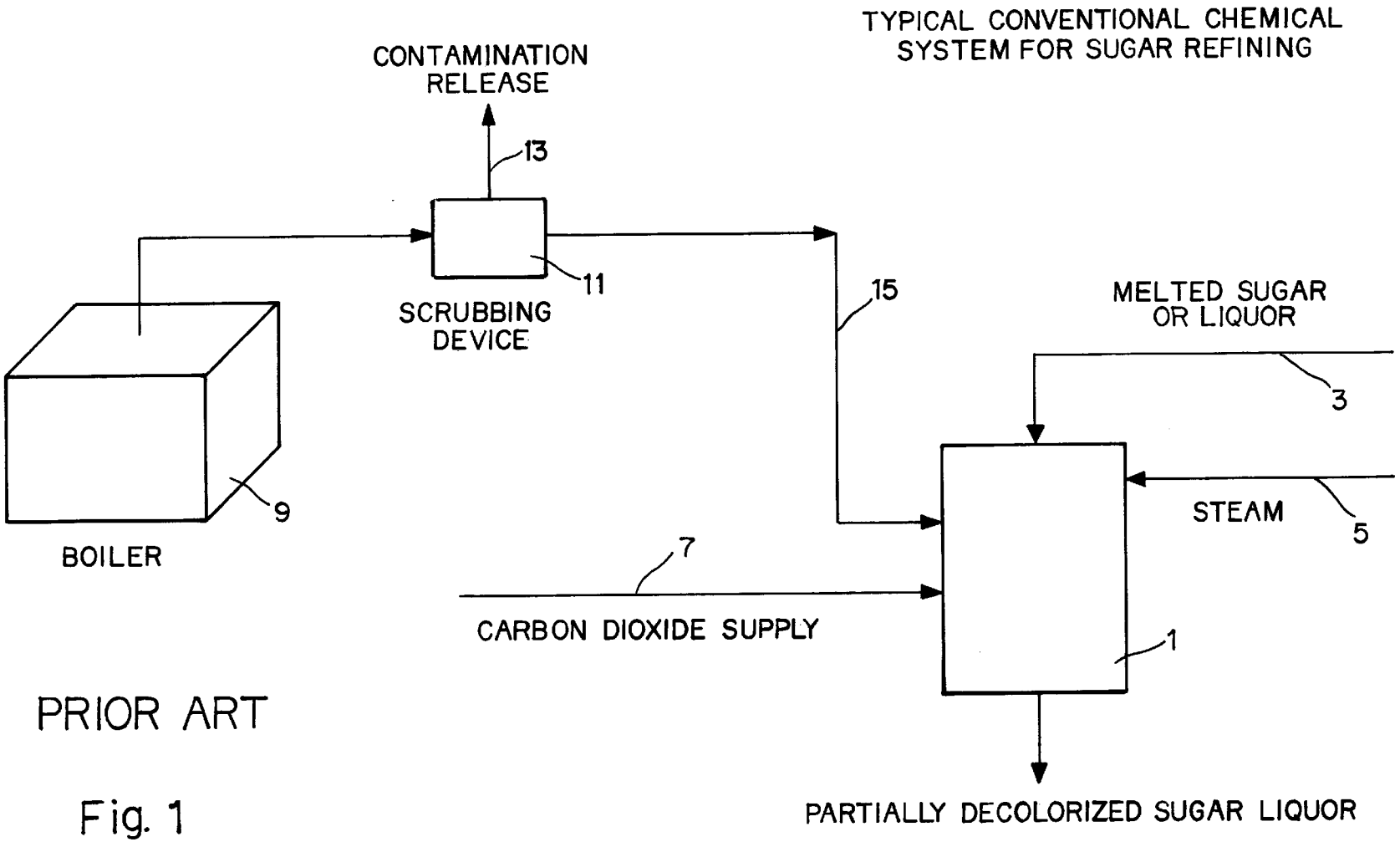
PRIOR ART Fig. 1
FIG. 1 provides a block diagram of a typical sugar refining process of the prior art.

FIG. 1 shows a typical sugar refining system of the prior art. This figure does not purport to depict all of the steps in a sugar refining process; the present invention is concerned only with the carbonation step, described above.

The carbonation process takes place in reactor 1. Melted sugar, also known in the art as liquor, enters the reactor through line 3. This is the unrefined sugar which has a light brown color. Steam is injected into the reactor through line 5. Carbonation is accomplished with carbon dioxide which is derived primarily from the exhaust gas of boiler 9. The boiler is used to heat water to provide the steam which enters the reactor in line 5, thereby heating the contents of the reactor.

The exhaust gas is purified in scrubber 11, which removes particulates and other impurities, as symbolized by arrow 13. If the fuel used by the boiler is natural gas, the output of the scrubber comprises a stream having about 6-9% carbon dioxide, by volume. This stream is carried by line 15 into the reactor. The output of the reactor is a partially decolorized sugar liquor, which results from the fact that the carbon dioxide reacts with calcium in the raw sugar to produce calcium carbonate, which precipitates out and which is removed by filtration.

Supply line 7 comprises a backup source of carbon dioxide, for use if the supply of carbon dioxide originating in the boiler is reduced. This backup source could be a compressed gas cylinder, or any other equivalent source.

Figure 2:
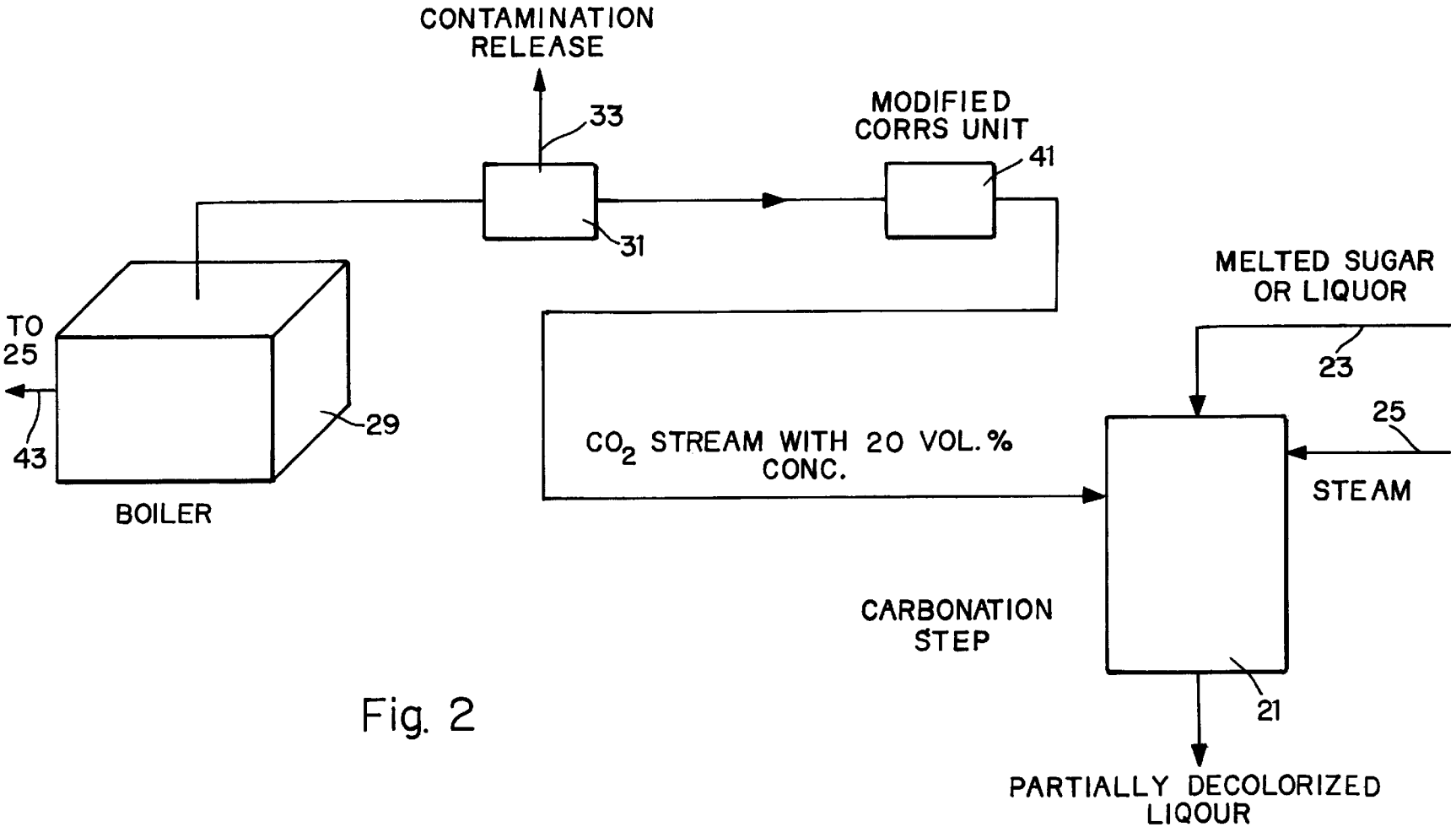
FIG. 2 provides a block diagram of the sugar refining process of the present invention.

FIG. 2 shows the configuration of the system of the present invention. Reactor 21, steam line 25, and raw sugar line 23 correspond, respectively, with elements 1, 5, and 3 of FIG. 1. Arrow 43 symbolically indicates that the boiler produces steam which is fed to reactor 21 through line 25. In the arrangement of FIG. 2, there is no backup carbon dioxide supply line corresponding to line 7 of FIG. 1. Instead, the sole supply of carbon dioxide originates with the boiler exhaust. Thus, the carbon dioxide used for carbonation always comes from the same source used to produce steam which drives the reaction.

Boiler 29 delivers exhaust or flue gas to scrubber 31, which removes impurities, as symbolized by arrow 33. The purified flue gas then flows into gas separation membrane module 41. The membrane module typically contains a large number of tiny polymeric hollow fibers. The wall of each fiber comprises a membrane formed of a gas-permeable polymer, and the gas is made to flow through this membrane. In practice, each fiber may have a diameter comparable to that of a human hair, and a single module may contain millions of such fibers. Because the various components of the gas have differing permeation rates through the polymer, a membrane module produces a stream of gas having an enhanced concentration of one or more components. In the present invention, one must choose the polymer such that it exhibits good selectivity for carbon dioxide. Such polymers are known in the art, and are commercially available.

The preferred membrane module, used in the present invention, is a product which is sold under the trademark and service mark CORRS, by MG Generon, Inc., of Malvern, Pa. This module may be constructed according to technology described in U.S. patent applications Ser. No. 09/158,271 and Set. No. 09/057,126, the disclosures of which are incorporated by reference herein. However, the invention is not limited to use of a particular module. Any gas separation membrane, which preferentially separates carbon dioxide from other gases, may be used. It is preferred that the membrane be such that it can efficiently increase the concentration of carbon dioxide from the range of about 6–9% by volume, to about 20% by volume. The gas stream having the enhanced concentration of carbon dioxide can then be injected into the reactor to accomplish the carbonation step.

The membrane module may comprise one or more stages. The present invention will normally require only one stage, because it is only necessary to bring the carbon dioxide concentration up to about 20%. If a higher concentration of carbon dioxide is desired, such as in cases in which the sugar refinery has a higher throughput capacity and requires a larger mass flow of carbon dioxide, one can provide a module having more than one stage. Membrane separation systems which provide carbon dioxide in concentrations of up to 90% are available.

The use of a polymer membrane to provide the necessary carbon dioxide, for the carbonation process, is particularly advantageous, because the membrane module has no moving parts, and therefore requires comparatively little maintenance. The membrane system eliminates the need for handling special chemicals, such as monoethanolamine, mentioned above. The membrane system also produces no hazardous wastes.

The present invention allows the user to increase the productivity of a sugar refining plant with a comparatively modest investment. By using the gas separation module, the present invention provides a gas stream having substantially enhanced carbon dioxide content (about 20% compared with the 6–9% available from the flue gas) for use in carbonation. The present invention therefore makes it easy to optimize the process of decolorization of raw sugar, by providing a reliable carbon dioxide supply.

The present invention also reduces or eliminates the need for a separate source of pure carbon dioxide, because the amount of carbon dioxide that can be delivered by the membrane module is sufficient to satisfy the throughput of most existing sugar refineries. In the present invention, the cost of the carbon dioxide is directly related to the cost of electricity and/or fuel at the plant, because the carbon dioxide is derived solely from the boiler exhaust.

The present invention is particularly useful in retrofitting existing sugar refining plants. Most existing plants do not have the capacity to process sugar at a rate sufficient to consume a stream of pure carbon dioxide. A stream having a concentration of 20% $CO_2$ is more than adequate for existing applications. By retrofitting existing plants with the system of the present invention, one can therefore substantially increase productivity with relatively little expense.

The invention can be modified in various ways. The composition of the polymer, and/or the number of stages, in the gas separation module, can be changed. Although FIG. 2 does not so indicate, it is still possible to provide a backup carbon dioxide source, if desired. These and other modifications, which will be apparent to the reader skilled in the art, should be considered within the spirit and scope of the following claims.

What is claimed is:

1. A method of refining raw sugar, the method comprising:

a) removing contaminants from a flue gas of a boiler, the flue gas containing carbon dioxide, wherein the flue gas becomes a purified gas, b) directing the purified gas through a gas separation membrane module, the module containing a polymeric membrane comprising means for providing an output stream having an enhanced concentration of carbon dioxide, and c) directing the purified gas from the gas separation module into a reactor containing raw sugar, so as to accomplish carbonation of contents of the reactor.

2. The method of claim 1, wherein the flue gas contains carbon dioxide in a concentration of about 6–9% by volume, and wherein step (b) comprises selecting the polymeric membrane such that the output stream has a concentration of carbon dioxide of about 20% by volume.

3. The method of claim 1, wherein the boiler comprises a sole source of carbon dioxide for carbonation, wherein carbonation is accomplished without obtaining carbon dioxide from any other source.

4. The method of claim 1, further comprising directing steam into the reactor, and wherein the steam is obtained by using said boiler to heat water to produce steam, wherein the same boiler which produces the steam also produces the carbon dioxide for carbonation.

5. In a method for carbonation of raw sugar, the method comprising the step of injecting carbon dioxide into a reactor containing raw sugar, the improvement wherein the carbon dioxide is produced by directing flue gas from a boiler into a module containing a polymeric membrane, the membrane comprising means for enhancing a concentration of carbon dioxide in the flue gas, and conveying the flue gas having enhanced carbon dioxide concentration from the module into the reactor.

6. The improvement of claim 5, further comprising the step of selecting the polymeric membrane such that the concentration of carbon dioxide in the flue gas is increased from about 6–9% by volume to about 20% by volume.

7. The improvement of claim 5, wherein the method is performed without obtaining carbon dioxide from any source other than the flue gas from the boiler.

8. The improvement of claim 5, wherein the method also includes directing steam into the reactor, and wherein the improvement further comprises obtaining the steam from said boiler, wherein the same boiler which produces the steam also produces the carbon dioxide for carbonation.

9. A sugar refining system, comprising:

a) a boiler, b) a scrubber, the scrubber being connected to receive flue gas from the boiler, c) a polymeric membrane, the membrane comprising means for enhancing a concentration of carbon dioxide in a gas passing through the membrane, the membrane being connected to receive flue gas from the scrubber, and d) a reactor, the reactor being connected to receive gas from the membrane, the reactor also being connected to a source of raw sugar, wherein the reactor comprises means for combining the raw sugar and a gas containing an enhanced concentration of carbon dioxide, so as to accomplish carbonation of the raw sugar.

10. The system of claim 9, wherein the flue gas contains carbon dioxide in a concentration of about 6–9% by volume, and wherein the polymeric membrane comprises means for increasing the concentration of carbon dioxide to about 20% by volume.

11. The system of claim 9, wherein the boiler comprises a sole source of carbon dioxide for carbonation.

12. The system of claim 9, further comprising means for directing steam into the reactor, wherein the same boiler which produces the steam also comprises means for producing the carbon dioxide for carbonation.

13. In a sugar refining process, the process comprising the steps of directing steam from a boiler into a reactor containing unrefined sugar and calcium, and injecting carbon dioxide into the reactor, wherein the carbon dioxide combines with the calcium in the reactor to produce calcium carbonate, and wherein the calcium carbonate is removed, by precipitation, so as to decolorize the sugar, the improvement wherein the injecting step comprises the steps of directing exhaust gas from the boiler through a gas-permeable polymeric membrane so as to produce a gas having an enhanced concentration of carbon dioxide, and conveying the gas leaving the membrane into the reactor.

14. The improvement of claim 13, wherein the injecting step is performed solely with gas derived from the exhaust gas of the boiler.

15. The improvement of claim 13, further comprising the step of removing contaminants from the exhaust gas from the boiler before directing the exhaust gas into the membrane.

16. In a sugar refining system, the system comprising means for directing steam from a boiler into a reactor containing unrefined sugar and calcium, and means for injecting carbon dioxide into the reactor so as to decolorize the sugar by precipitation of calcium carbonate, the improvement comprising means for directing exhaust gas from the boiler through a gas-permeable polymeric membrane so as to produce a gas having an enhanced concentration of carbon dioxide, and means for conveying the gas leaving the membrane into the reactor.

17. The improvement of claim 16, wherein the carbon dioxide injected into the reactor is derived solely from the exhaust gas of the boiler.

18. The improvement of claim 16, further comprising means for removing contaminants from the exhaust gas from the boiler before directing the exhaust gas into the membrane.

* * * * *